United States Patent [19]

Wu

[11] Patent Number: 4,585,271

[45] Date of Patent: Apr. 29, 1986

[54] COLLAPSIBLE BABY CHAIR

[76] Inventor: Ching-Tang Wu, No. 33, Lane 103, Hansheng E. Rd., Panchiao City, Taipei Hsien, Taiwan

[21] Appl. No.: 634,388

[22] Filed: Jul. 25, 1984

[51] Int. Cl.[4] ..... A47B 83/02

[52] U.S. Cl. ..... 297/174; 297/441

[58] Field of Search ..... 297/234, 440, 441, 174

[56] References Cited

U.S. PATENT DOCUMENTS

| | | | |
|---|---|---|---|
| 3,052,500 | 9/1962 | Hyde | 297/174 |
| 4,312,535 | 1/1982 | Smith | 297/174 |
| 4,469,373 | 9/1984 | Simmons et al. | 297/174 |
| 4,506,928 | 3/1985 | Marion | 297/134 |

FOREIGN PATENT DOCUMENTS

| | | | |
|---|---|---|---|
| 2443455 | 3/1976 | Fed. Rep. of Germany | 297/174 |

*Primary Examiner*—Francis K. Zugel

*Attorney, Agent, or Firm*—Birch, Stewart, Kolasch & Birch

[57] ABSTRACT

A collapsible baby chair suitable for suspending on a rigid surface through a supporting frame with which the chair is clamped from the rigid surface, the supporting frame including a pair of U-shaped members pivoted with each other intermediately at the transverse sections thereof, the two members can be swung through a circular angle with respect to each other, in turn, the longitudinal sections of the U-shaped members on each side are separated and receive the rigid surface to be clamped. A seat member consists of a cloth sling having two sides, suspended on the longitudinal at the two sides, with an extension of the side rolled inwardly in such a manner as to accept the two adjacent longitudinal sections, and the edge portion thereof being inserted into the separation from the inner side, in such a manner, as the cloth ends are interposed between the two adjacent longitudinal sections, therefore, the two adjacent sections will be drawn near and hold down the edge portion of the rigid surface squeezed therebetween due to the downward force caused by the weight of the baby on the seat.

1 Claim, 3 Drawing Figures

COLLAPSIBLE BABY CHAIR

BACKGROUND OF THE INVENTION

This invention relates to a collapsible chair and particularly concerns a collapsible baby chair capable of being clamped on a rigid surface such as the edge of table to provide a seat for a baby.

Prior to the present invention, the baby chair, especially those suitable for use in a dining room, were mostly made of wood and typically include long legs and a seat, such kind of chairs are heavy and bulky. Furthermore, the inherent structure thereof can not provide safeguards for the baby, therefore, it may be dangerous if the baby is left unattended by an adult.

SUMMARY OF THE INVENTION

Accordingly, it is a general object of this invention to provide a collapsible butterfly baby chair which can be clamped on a proper rigid surface to provide a seat for a baby.

It is another object of this invention to provide a collapsible butterfly baby chair having a cloth sling secured to the supporting frame in a manner without any fasteners.

Generally, the present invention proposes a collapsible baby chair capable of being clamped on a rigid surface to provide a seat for a baby, which comprises a supporting frame, including a first U-shaped member and a second U-shaped member, having a pair of longitudinal sections and a transverse section respectively, the first and second U-shaped members being pivoted with each other intermediately at the transvese sections thereof and thus capable of being swung with respect to each other, thereby the angle between the first and second U-shaped members being varied to adapt the thickness of the rigid surface to be clamped; a seat member having two sides being suspended from the pairs of longitudinal sections of the first and second U-shaped members.

According to another feature of this invention, the longitudinal sections of both the first and second U-shaped members include a longer one and a shorter one respectively.

BRIEF DESCRIPTION OF THE DRAWINGS

In the accompanying drawings, like numerals designate similar parts throughout the several views.

DETAILED DESCRIPTION OF THE PREFERRED EMBODIMENT

Figure 1:
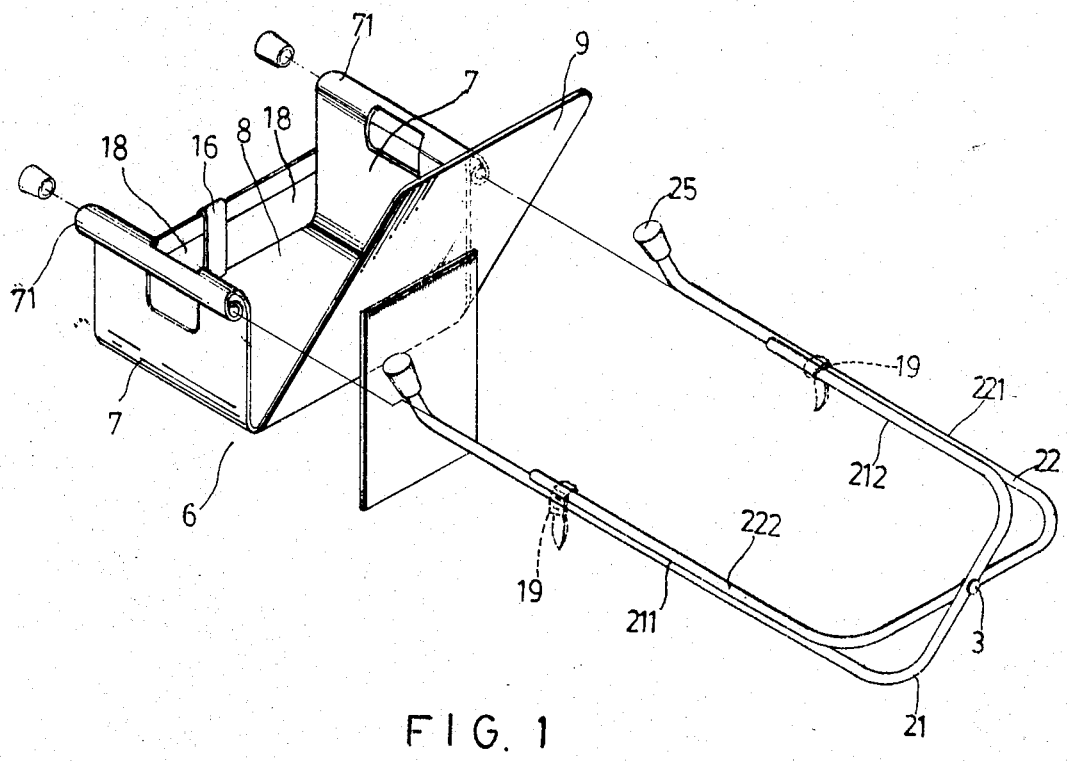
FIG. 1 is an exploded view of the baby chair according to a preferred embodiment of the invention.
Figure 2:
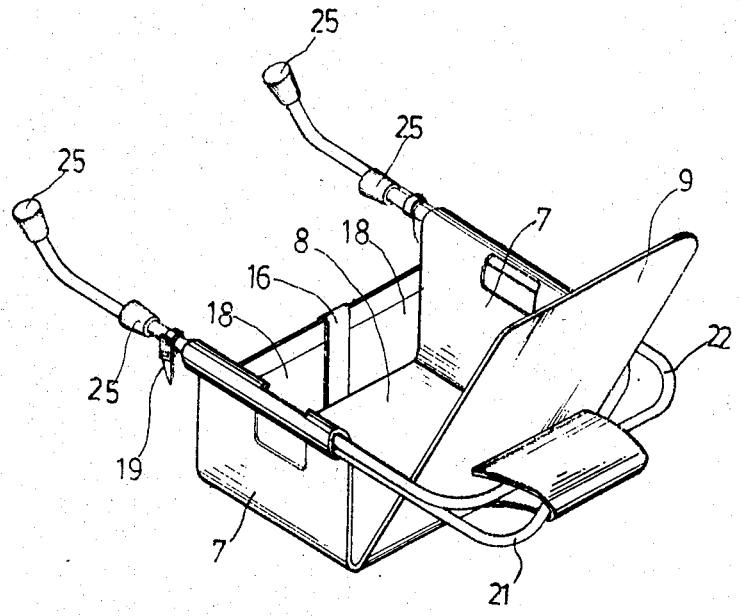
FIG. 2 is a perspective view of the baby chair shown in FIG. 1.

Referring now, in particular to the accompanying drawings, the baby chair generally includes two parts, the steel tubing supporting frame and the cloth sling. The steel tubing supporting frame consists of a pair of U-shaped members, referred to as the first and the second U-shaped members 21, 22 respectively, the longitudinal sections 211, 212, 221, 222 of the U-shaped members 21, 22 are made of different lengths, that is, one is longer than the other. Two longitudinal sections 211, 221 of longer size are bent at obtuse angles on the respective non-riveted end. In addition, the free ends of the longitudinal sections are covered by caps 25 respectively made of abrasive material, and with the cap 25 to frictionally engage the surface to be clamped.

At middle point of the pair of U-shaped member 21, 22 a rivet 3 connects the two members and permits them to swing with respect to each other.

Figure 3:
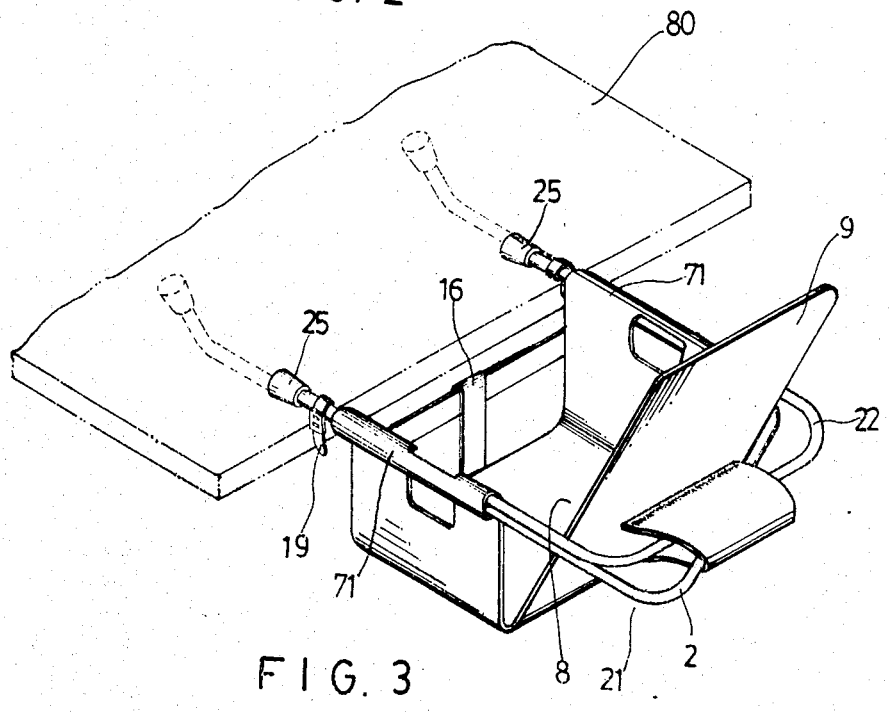
FIG. 3 is an illustration of the baby chair clamped onto a rigid flat surface.

According to the invention, the U-shaped members 21, 22 not only act as supporting member of the cloth sling but also provide clamping surface with respect to a rigid surface, such as the table surface. For the latter purpose, as can be seen in FIG. 3, the pair of U-shaped members 21, 22 can be swung to form an angle therebetween and the longitudinal sections are thereby separated, with a separation such that the rigid surface 80 can be received therebetween. The supporting frame clamps tightly onto the rigid surface 80 substantially without auxiliary means except for the weight of a baby who sits on the seat member, this will be further described in the accompanying embodiment.

In order to further secure the two adjacent longitudinal sections on their respective sides to tightly clamp onto the rigid surface 80, a pair of adjustable straps 19 are employed to fasten the adjacent longitudinal sections at a position in front of the side portions 7, 7 of the seat member 6, so as to prevent the supporting frame from coming loose and causing the chair to fall down.

The seat member 6 is comprised of a cloth sling in a single piece fabricated with a substantial T-shape, including a back portion 9, a bottom portion 8 and two side portions 7, 7 extending from opposite edges of the bottom portion 8.

The cloth extensions 71, 71 formed at the upper end of the side portions 7, 7 are provided for suspending the seat on the supporting frame. This is achieved by rolling inwardly the cloth extensions 71, 71 in such a manner as to accept the adjacent longitudinal sections on one side, then inserting the edge portion of the cloth extension into the separation between the adjacent longitudinal sections, a similar operation is applied with respect to the adjacent longitudinal sections on the other side so that the two sides are suspended from the longitudinal sections on each side respectively and a seat is prepared. When a baby sits on the seat which has been clamped onto a rigid surface 80, the weight of the baby will draw near the two adjacent longitudinal sections caused by the pivoting movement of the pair of U-shaped members, as a result, the pair of U-shaped members 21, 22 will grip the rigid surface 80 more tightly.

A T-shaped safety band 16 is attached to the front ends of the side portions 7, 7 of the cloth sling for preventing a baby from falling down from the seat, through the openings 18, 18 the baby can stretch out his legs, but still be prevented from falling down from his seat.

While the invention has been described in connection with what is presently considered to be the most practical and prefered embodiments, it is to be understood that the invention, is not to be limited to the disclosed embodiment, but on the contrary, is intended to cover various modifications and equivalent arrangements included within the spirit and scope of the appended claims which scope is to be accorded the broadest interpretation so as to encompass all such modifications and equivalent structures.

I claim:

1. A collapsible baby chair capable of being clamped on a rigid surface to provide a seat for a baby, comprising:

a supporting frame adapted to clamp a rigid surface, including a first U-shaped member and a second U-shaped member, having a pair of longitudinal sections and a transverse section respectively, said first and second U-shaped members being pivoted with each other intermediately at said transvese sections thereof and thus capable of being swung with respect to each other, thereby the angle between said first and second U-shaped members being varied to adapt the thickness of the rigid surface to be clamped;

a seat member having two sides being suspended from said pairs of longitudinal sections of said first and second U-shaped members.

* * * * *